US005281164A

United States Patent [19]

Gan

[11] Patent Number: 5,281,164

[45] Date of Patent: Jan. 25, 1994

[54] TURN-AND-PRESS TYPE OF WIRE CONNECTOR

[76] Inventor: Jin-Mou Gan, No. 2-1, Chung-Fu Rd, Sec. 2, Chung Li city, Taiwan

[21] Appl. No.: 916,546

[22] Filed: Jul. 20, 1992

[51] Int. Cl.[5] ..... H01R 4/24

[52] U.S. Cl. ..... 439/409

[58] Field of Search ..... 439/389–425

[56] References Cited

U.S. PATENT DOCUMENTS 4,341,430 7/1982 Crawford ..... 439/409

4,426,125 1/1984 Crawford ..... 439/409

4,995,829 2/1991 Geib et al. ..... 439/409

*Primary Examiner*—Joseph H. McGlynn

*Attorney, Agent, or Firm*—W. Wayne Liauh

[57] ABSTRACT

A wire connector which comprises a connector body and a turn-and-press member; the connector body is a member made of a plastic material, and is formed in shape with an injection molding; both sides of the connector body have two fastening hooks respectively, which each has a hook hole for receiving a turn-and-press member; the connector body embeds a plurality of conductive copper pieces arranged separately and regularly one another. The lower both ends of the turn-and-press member has two fastening studs respectively, and the lower edge thereof has a plurality of wire holes arranged separately and regularly;such wire holes are at an angle in relation to the flat surface of the turn-and-press member. An electrically conduction can be made upon the member being turned and pressed in a simple and sure operation manner.

2 Claims, 5 Drawing Sheets

TURN-AND-PRESS TYPE OF WIRE CONNECTOR

BACKGROUND OF THE INVENTION

Generally, electrical wires are connected by soldering or riveting method, which requires a considerable manpower aside from having unstable conduction result; as a result, the quality of an electric product might be affected. Recently, there has been a blade type of wire connector, which can cut the wire insulator for conduction, and can improve the assembling efficiency, but still has some drawbacks, such as the wire size being an important factor; for example, if the wire is too fine, the blade will be unable to cut the copper core of a wire, and a desired conduction result can not be obtained.

SUMMARY OF THE INVENTION

The present invention comprises a connector body and a turn-and-press member; the front end of the connector body has two fastening hooks on both sides thereof; the hook holes in the fastening hooks are used for receiving the turn-and-press member. The connector body embeds a plurality of conductive copper wires arranged separately and regularly; the front ends of the conductive copper wires extend out between the two fastening hooks to form into cutting pieces, while the rear ends of the wires extend out of the rear end of the connector body for further connection. The turn-and-press member is a board-shaped member, of which the lower end has two fastening studs on both sides thereof, and they are to be mated with the connector body. The bower end of the Turn-and-press-press member has a plurality of holes arranged separately at am angle to the flat surface of the turn-and-press member to facilitate wires to insert in and the cutting pieces to cut wires upon the turn-and-press member being turned.

DETAILED DESCRIPTION

Figure 1:
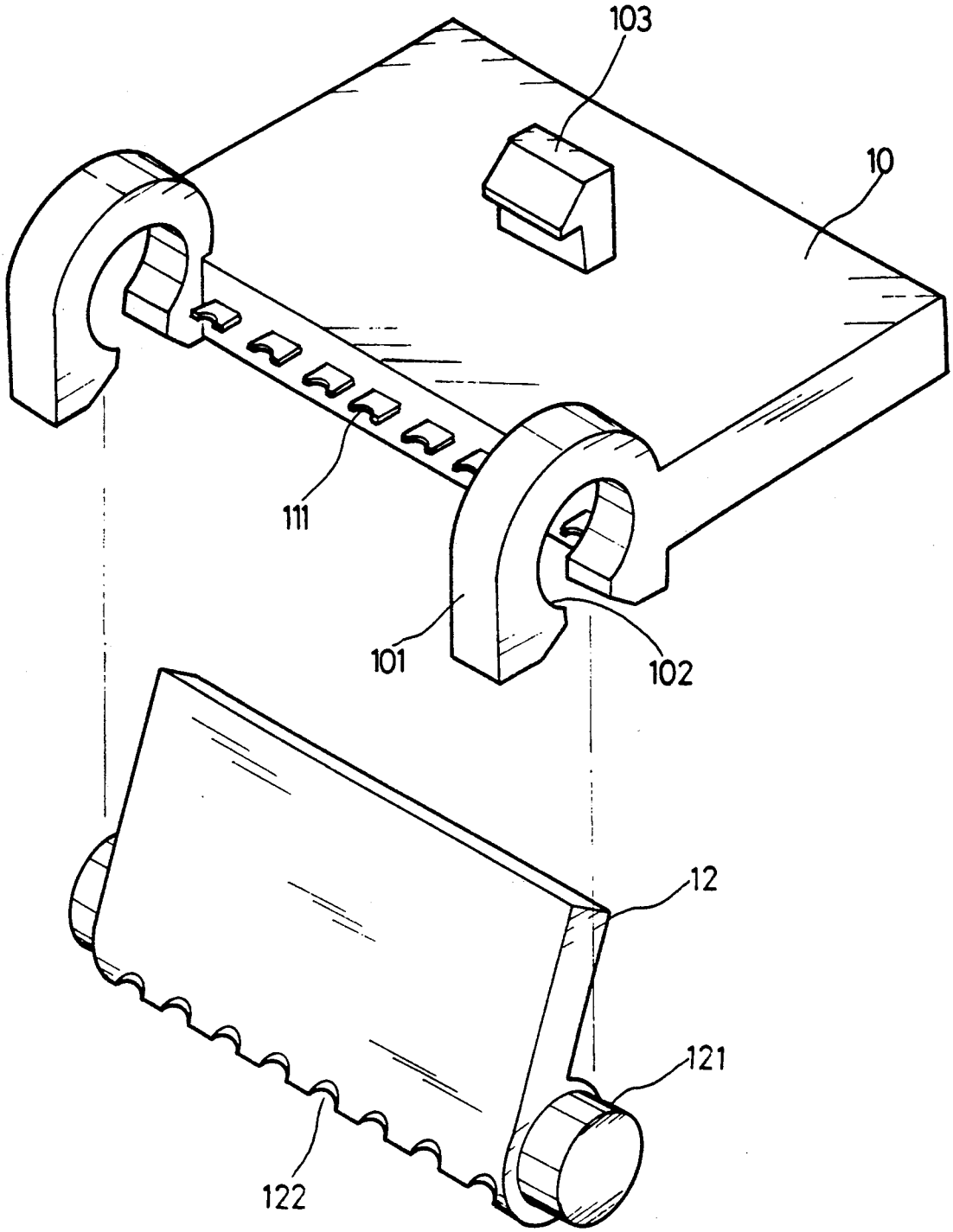
FIG. 1 is a disassembled view of am embodiment according to the present invention.

The present invention comprises a connector body 10 and a turn-and-press member 12.

The connector body 10 is made of a plastic material to be formed with an injection molding method; the connector body includes a plurality of conductive copper pieces 11 arranged linearly with a space one another. The tail 112 of each conductive copper piece 11 extends is a connecting channel 104 in the rear end of the connector body 10, while the other end thereof is formed into a cutting piece 111 fixed in the other end of the connector body between two fastening hooks 101. Each cutting Piece 111 has a curved front end, which can cut the the wires to be connected. Both front sides of the connector body 10 have two fastening hooks 101 respectively, of which has a hook hale 102 on the turn-and-press member 12. The top center part of the connector body 10 has a catching stop 103 to retain the turn-and-press member 12, of which the sectional view is similar to a 'b' with two round fastening studs 121, on both sides thereof to be mated with the two hook holes 102 respectively.

The lower end of the turn-and-press member 12 has a plurality of wire holes 122 being spaced apart from one another; all the wire holes are furnished at an angle with the flat for of the turn-and-press member 12 so as to facilitate wires to insert through. It is preferred that the wire holes are formed at an angle perpendicular to the axis of the bottom cylinder 121 of the turn-and-press member 12.

Figure 2A:
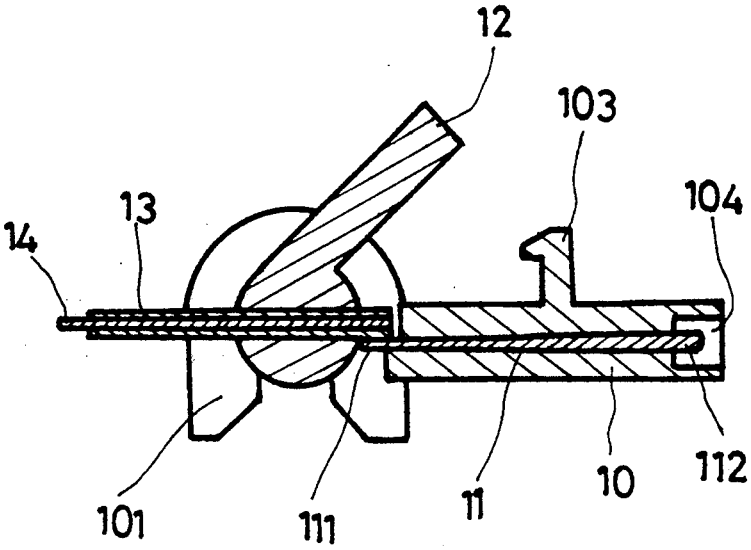
FIG. 2A illustrates a wire being inserted in the present invention before the same being turned and pressed.
Figure 2B:
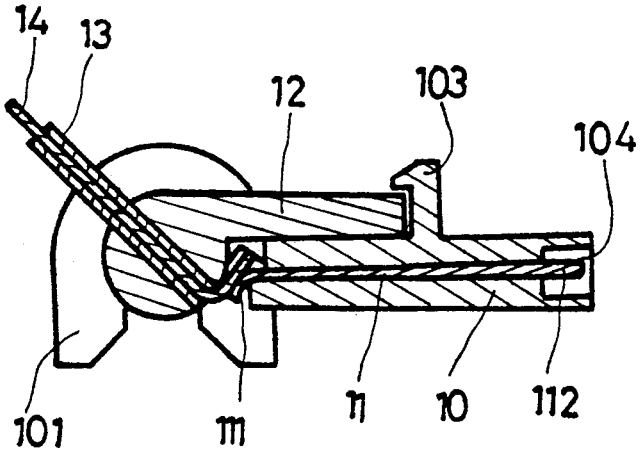
FIG. 2B illustrates the present invention having completed the turning-and-pressing steps.
Figure 5:
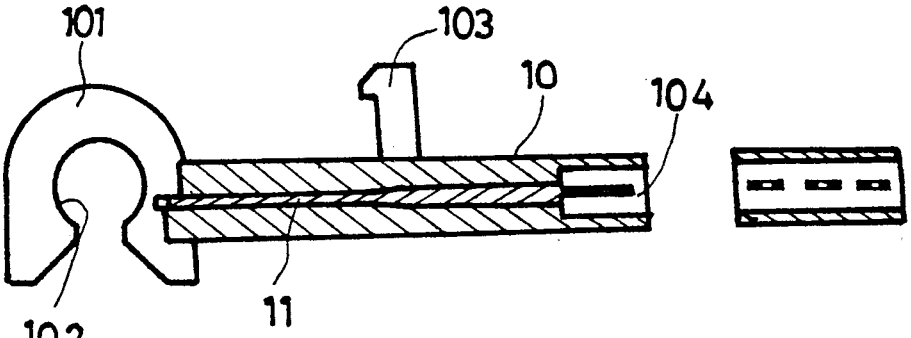
FIG. 5 illustrates a suitable form of the tail portion of the conducting copper piece according to the present invention.
Figure 3A:
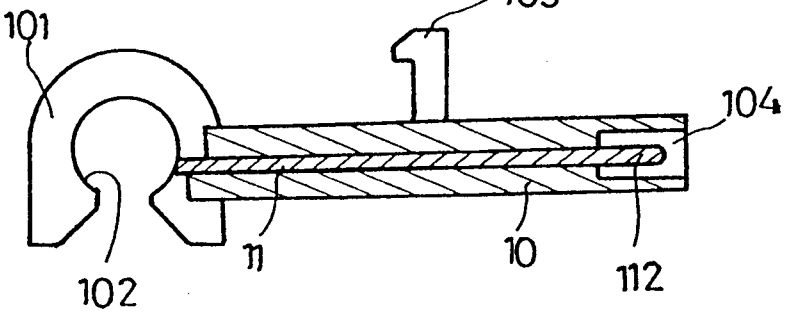
FIG. 3A is a front view of the connector body i to the present invention.
Figure 3B:
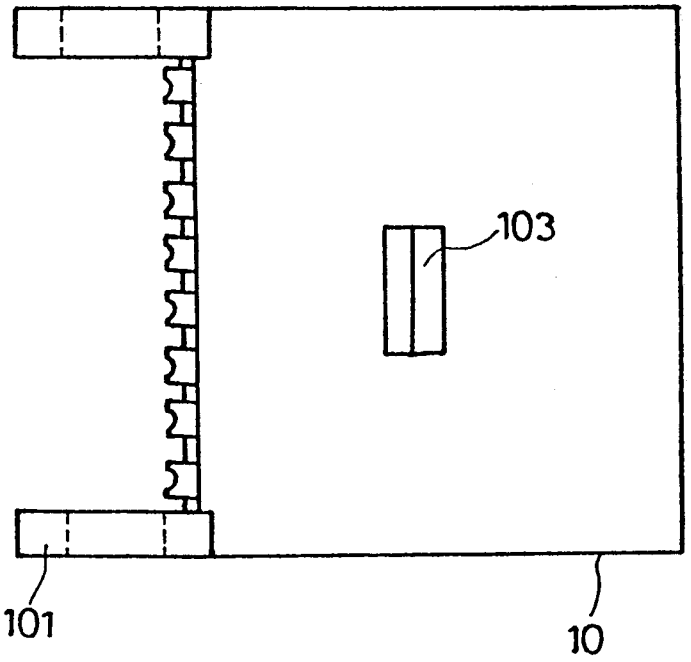
FIG. 3B is a top view of the connector body.
Figure 3C:
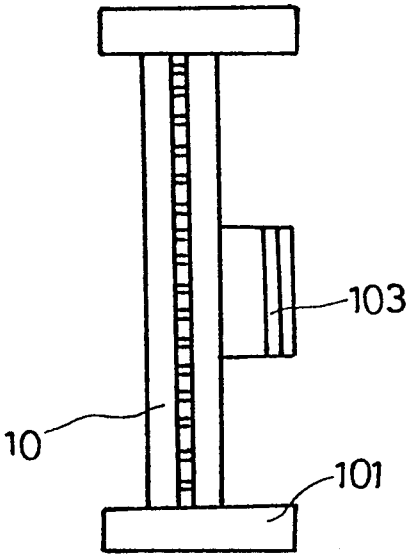
FIG. 3C is a side view of the connector body.
Figure 4:
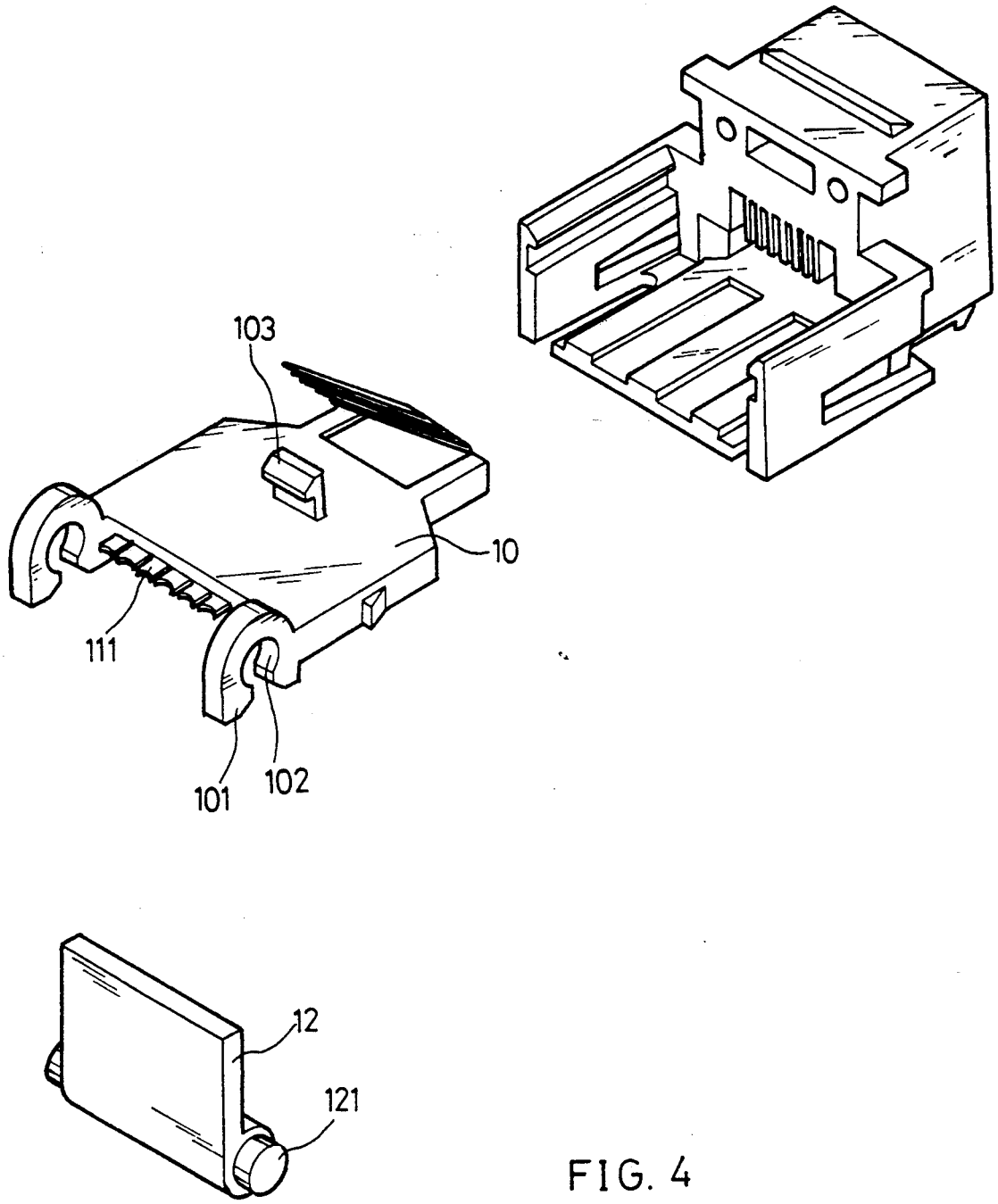
FIG. 4 illustrates the present invention being used for electrical connection.

Referring to FIGS. 2-1 and 2—2, the features of the present invention are that when wires are inserted into the hales, before the member 12 being turned as shown in FIG. 2-1, the wires 13 are not applied with pressure. FIG. 2—2 illustrated the wires have been turned and pressed with the turn-and-press member 12, which is already caught with the catching stop 103; simultaneously, the insulating outer layer on the front ends of the wires will be cut by the cutting pieces 111 respectively. The copper cores of the wires will be in close contact with the cutting pieces 111 respectively. FIGS. 4 and 5 illustrate the present invention being in practical use.

In brief, the present invention is deemed an excellent wire connector with a simple structure; it can be used efficiently without using conventional soldering or riveting method, and without causing the drawbacks resulted by using the conventional cutting for conduction; further, the present invention can provide a larger contact area for better conduction as shown in FIG. 2—2 (while the conventional cutting method can only furnish a point-contact conduction on both sides of a blade).

I claim:

1. A turn-and-press type wire connector, comprising:

(a) a connector body having a front end and a rear end, and a turn-and-press member;

(b) said connector member having a plurality of spaced apart conductive copper pieces embedded therein, each of said conductive copper piece having a first end extended out of the rear end of said connector body to allow for further electrical connection and a second end formed into a cutting piece fixed and exposed in the front end of said connector body for tangentially stripping the insulating coating of said wire to be connected therewith, said connector body further containing two spaced apart hook holes formed on the front end of said connector body for pivotably receiving and fastening said turn-and-press member;

(c) said turn-and-press member having a relatively flat upper portion, a generally cylindrical bottom portion, and a fastening stud on each end of said cylindrical bottom portion, each of said fastening stud being adapted to be inserted into a mating hook hole in said connector body to allow for the pivoting movement of said turn-and-press member, said turn-and-press member further contains a plurality of spaced apart wire holes which are formed through said cylindrical bottom portion of said turn-and-press member in a direction generally perpendicular to the axis thereof for receiving wires to be connected to said copper pieces; and (d) whereby in the process of making an electrical connection between said wires and said copper pieces, said wires are first inserted through said wires holes of said turn-and-press member, which is then turned and pressed against connector body thereby causing said cutting pieces of said copper pieces in said connector body to axially peal off an insulating outer layer from said wires so that an axially extending length of bare wire is pressed firmly parallel to and against said copper piece to provide electrical connection therebetween.

2. The turn-and-press type wire connector of claim 1 wherein said connector body further contains a catching stop for affixing said turn-and-press member.

* * * * *